US005669295A

United States Patent [19]

Kayser et al.

[11] Patent Number: 5,669,295

[45] Date of Patent: Sep. 23, 1997

[54] CALENDER FOR TREATING BOTH SIDES OF A PAPER WEB

[75] Inventors: Franz Kayser, Geldern; Rolf van Haag, Kerken; Ulrich Rothfuss, Grefrath, all of Germany

[73] Assignee: Voith Sulzer Finishing GmbH, Krefeld, Germany

[21] Appl. No.: 612,258

[22] Filed: Mar. 7, 1996

[30] Foreign Application Priority Data

Mar. 9, 1995 [DE] Germany ..... 195 08 353.9

[51] Int. Cl.[6] ..... B30B 3/04; D21G 1/00

[52] U.S. Cl. ..... 100/331; 100/162 B; 100/163 A; 100/167; 100/172

[58] Field of Search ..... 100/38, 93 RP, 100/93 R, 92, 161–167, 172

[56] References Cited

U.S. PATENT DOCUMENTS

| | | | |
|---|---|---|---|
| 440,377 | 11/1890 | Snover | 100/166 |
| 628,570 | 7/1899 | Witham | 100/92 |
| 715,017 | 12/1902 | Cameron | 100/167 |
| 1,498,237 | 6/1924 | Daniels | 100/167 |
| 2,300,994 | 11/1942 | Thiele et al. | 100/163 A |
| 3,153,378 | 10/1964 | Nelson | 100/38 |
| 3,270,664 | 9/1966 | Veneman et al. | 100/162 R |
| 4,653,395 | 3/1987 | Verkasalo | 100/93 RP |
| 4,738,197 | 4/1988 | Mälkiä | 100/93 RP |

FOREIGN PATENT DOCUMENTS

| | | |
|---|---|---|
| 38 21 027 | 12/1989 | Germany . |
| 42 02 047 | 7/1993 | Germany . |
| 2 049 516 | 12/1980 | United Kingdom . |

OTHER PUBLICATIONS

"Die neuen Superkalanderkonzepte", Voith Sulzer Papiertechnik, 1994, No. 05/94 d.

*Primary Examiner*—Stephen F. Gerrity
*Attorney, Agent, or Firm*—Darby & Darby

[57] ABSTRACT

A calender for the two-sided treatment of a paper web has two similar stacks each of which has at least two soft rollers and two hard rollers. Working nips are formed between each hard and soft roller. The calender has at least one working nip wherein the dwell time (t) is at least 0.1 ms, the surface temperature (T) is at least 100°C., and the load (P) on the stack creates an average compressive stress in the working nip of more than 42 N/mm$^2$. This provides a calender that is smaller and less expensive to manufacture and operate than super-calenders of the prior art but that also affords excellent finishing results.

15 Claims, 1 Drawing Sheet

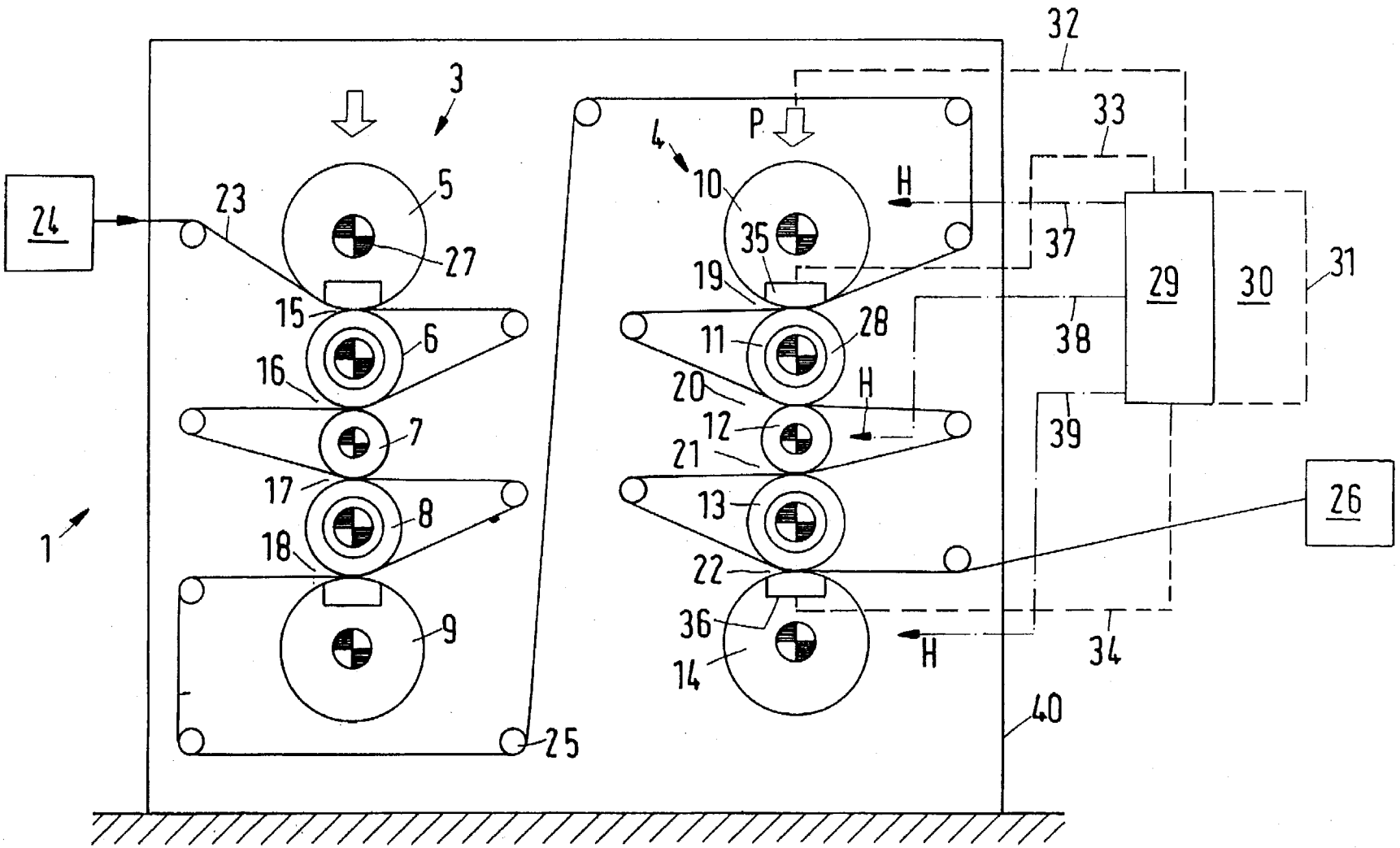
26
31
30
29
33
32
37
38
39
34
40
H
H
H
28
P
35
10
19
11
20
12
21
13
22
36
14
4
25
3
5
27
6
7
8
9
15
16
17
18
23
24
1

CALENDER FOR TREATING BOTH SIDES OF A PAPER WEB

BACKGROUND OF THE INVENTION

1. Field of the Invention

The present invention relates to a calender for treating both sides of a paper web. more specifically, the present invention relates to a calender for manufacturing paper that can be used in photogravure printing. The calender includes two roller stacks that each can be loaded from the end. The calender includes "hard" rollers and "soft" rollers. Working nips are formed between the juncture of a hard roller and a soft roller. A roller surface, disposed adjacent to the working nip, can be heated.

2. Discussion of the Related Art

Many calenders of this type are known, for example, from the 1994 brochure "Die neuen Superkalanderkonzepte" [The New Supercalender Concepts] which is published by Sulzer Papertec Company (identification number 05/94 d). These calenders are used for the final treatment of a paper web so that the web will obtain the desired degree of roughness or smoothness, gloss, thickness, bulk and the like. These supercalenders are installed separately from a paper machine. The soft or elastic rollers have an outer covering that is primarily made of a fibrous material. The heatable rollers have a surface temperature up to about 80° C. The average compressive stress in the working nips during normal operation is between 15 and 30 N/mm$^2$, while maximum values of approximately 40 N/mm$^2$ have also been applied in the lowest working nip. The rollers are arranged in a roller stack. A roller stack with 9 or 10 rollers is sufficient for paper that is to be simply finished, such as writing paper. A stack with 12 to 16 rollers is required for higher quality paper, such as paper suitable for photogravure printing, technical papers or compression papers. However, a large machine of this type is expensive and requires a great deal of space.

In addition, so-called compact calenders are known in which a heatable roller forms a nip with a deflection-controllable soft roller. Two compact calenders can be connected in series to treat both sides of a paper web. However, these calenders can only be used to manufacture paper that requires simple finishing, but not higher quality papers, such as silicon based paper or paper for photogravure printing. Moreover, compact calenders require that a large amount of deformation energy, in the form of heat be added to operate the calender. The heatable rollers, therefore, have a surface temperature ranging from 160° to 200° C. A large amount of heat energy is radiated that must then be exhausted using air conditioners. Because the roller diameter in a compact calender is larger (for sturdiness purposes) than the roller diameter in a supercalender, higher loads per unit of length must be applied to produce the required compressive stresses for the desired finishing result. Furthermore, replacement rollers for the soft rollers are expensive because they must also be deflection-controllable.

SUMMARY OF THE INVENTION

It is an object of the present invention to provide a calender of the type described above that is smaller and less expensive to manufacture and operate but that nonetheless also affords excellent finishing results.

This object is achieved in accordance with a preferred embodiment of the present invention by providing two similar stacks with five rollers each and by having at least one working nip fulfill the following requirement:

a) The nip width is selected such that the dwell time is at least 0.1 ms;

b) The heating of a heatable roller, disposed adjacent to the working nip, so that the heatable roller has a surface temperature of at least 100° C.; and c) The load on the rollers has an average compressive stress in the working nip of at least 42 N/mm$^2$.

The effect of the roller weight on the load per unit of length is decreased by reducing the stack height. Therefore, it is possible to have the same load per unit of length in the lowest nip while working in the uppermost intake nip with a higher load per unit of length than is used in supercalenders of the prior art. It is, therefore, sufficient to moderately increase the deformation energy supplied, while still being able to process high-quality paper satisfactorily. For example, heat can be added at temperatures that are only slightly above the customary temperatures and, therefore, only slightly increase the heat radiation.

In addition, different forms of heat transfer media are available. As a result, the difficulties encountered at the higher temperatures, which must be used for compact calenders, are avoided. A relatively slight increase in the compressive stress is also sufficient but should be taken into account when selecting the covering material for the elastic roller. Since both factors (increased heat and increased load) can be applied simultaneously in at least one working nip, preferably the lowest working nip, positive results can be achieved even with a rapidly running calender and when producing high-quality paper. Because the roller stack is not as tall as supercalenders of the prior art, lower structures are sufficient, which significantly reduces installation costs.

The 2×5 roller calender provides practically the same finishing results as a conventional 12-roller calender that was previously considered necessary to produce paper suitable for photogravure printing and other high-quality paper. Division of the rollers into two stacks has the additional advantage that the load per unit of length is less dependent on the weight of the rollers, which means that operation is possible with a much higher load per unit of length in each of the uppermost nips than was previously the case.

Preferably, at least one working nip has a maximum dwell time of 0.9 ms. A maximum surface temperature of a roller disposed adjacent to the working nip is 150° C. The load creates a maximum average compressive stress of 60 N/ram$^2$. Therefore, only a moderate increase in the surface temperature and the compressive stress is actually necessary.

It is preferable for the dwell time to be 0.2 ms to 0.5 ms, the surface temperature to be 110° C. to 125° C., and the average compressive stress to be 45 N/mm$^2$to 55 N/mm$^2$. It is particularly advantageous for these parameters to apply to all the working nips or to at least the majority of the working nips. However, slight increases in the surface temperature and the compressive stress are sufficient because the increased values in these parameters are evenly distributed to multiple working nips.

It is preferable for the upper and/or lower rollers to be deflection-controllable. In this way, the compressive stress can be distributed evenly over the entire width of the rollers. In this regard, it is preferable that the upper and/or lower rollers be hard rollers that are heatable. Heat energy is preferably applied to the hard rollers because these rollers can be more easily heated than soft rollers. This is especially true when the upper and lower rollers are deflection-controllable, because the pressure fluid, which is used to adjust the deflection, can be heated to control the heating of these rollers.

It is particularly beneficial for the soft rollers to have an outer plastic covering. Plastic covered rollers operate significantly better than rollers that are covered with fibrous material at increased average compressive stresses. Preferably, the plastic covering permits operation at a compressive stress of more than 42 N/mm$^2$ and up to approximately 60 N/mm$^2$. The plastic covering is preferably made of fiber-reinforced epoxy resin, which typically has a useful life of at least 12 weeks.

In an additional embodiment of the present invention, the roller stack or stacks are arranged in-line (i.e., in series) with a paper machine or a coating machine. The paper web is thus at a relatively high temperature at the intake nip of the calender (e.g., 60° C.) and therefore the web only requires a slight addition of heat to provide sufficient deformation. Plastic coverings, which are already desirable because of the higher compressive stresses that they can withstand, are particularly suitable for in-line operations, because, in contrast with coverings made of fibrous material, they are significantly less susceptible to marking. Therefore, plastic coverings rarely need to be removed and reworked, for example, by grinding. Calenders comprised of two roller stacks have the additional advantage of being more suitable for in-line operation, because the running paper web in each stack is fed through a lower number of working nips.

Each of the rollers in a roller stack is preferably driven independently of the other rollers. The paper web can therefore be independently pulled in while the calender is running because all of the rollers can be brought to the same speed before the nips are closed.

The roller stack is preferably covered by a protective hood which reduces the amount of heat radiating from the calender. The protective hood ensures that the manufacturing facility is not overheated, which would require excessive air conditioning. Conversely, the temperature inside the hood is preferably maintained at a predetermined higher level than in conventional calenders, so that the addition of heat through the heating device can be minimized.

BRIEF DESCRIPTION OF THE DRAWING

The Single FIGURE is a schematic representation of the preferred calender in accordance with the present invention.

DETAILED DESCRIPTION OF THE PREFERRED EMBODIMENTS

Referring now to the Single FIGURE, a calender 1 has two roller stacks 3 and 4, each of which is comprised of five rollers. The first stack 3 has a heatable deflection-controllable hard upper roller 5, a soft roller 6, a heatable hard roller 7, a soft roller 8, and a heatable deflection-controllable hard lower roller 9. The second stack 4 has a heatable deflection-controllable hard upper roller 10, a soft roller 11, a heatable hard roller 12, a soft roller 13, and a heatable deflection-controllable hard lower roller 14. This arrangement produces four working nips 15–18 in the first stack 3 and four working nips 19–22 in the second stack 4. Each working nip is formed by the juncture of a hard roller and a soft roller.

A paper web 23 is fed out of a paper machine or coating machine 24. The web 23 runs through each stack 3, 4 from the top to the bottom under the control of guide rollers 25. The web 23 passes through the working nips 15–18 of the first stack 3 and then through the working nips 19–22 of the second stack 4, after which the web 23 is wound onto a winding device 26. In the first stack 3, the paper web 23 has only one of its sides contacting against the hard rollers and in the second stack 4, the other side of the paper web 23 contacts against the hard rollers so that the desired surface structure, such as smoothness and gloss, is produced on both sides. The direct connection between the calender 1 and the paper machine or coating machine 24 results in an in-line operation. For this reason, each of rollers 5 through 14 has its own drive 27, thus allowing the paper web 23 to be pulled in during operation. Each of the soft rollers 6, 8, 11, and 13 has an outer covering 28 made of plastic. In a preferred embodiment the outer covering 28 is made of a fiber-reinforced epoxy resin, which is less susceptible to marking than a covering made of a fibrous material. Thus, the soft roller has a significantly longer useful life, which is important for in-line operation. In addition, this material can be subjected to significantly higher compressive stresses and is also more resistant to higher temperatures than paper. This plastic covering is commercially available, for example, from the Scapa Kern Company of Wimpassing, Austria and is sold under the brand name "TopTec 4" TM.

A control unit 29 or 30 of a control device 31 is connected to each stack. Each of the control units 29, 30 has multiple functions, which are explained below for the second stack 4 but apply analogously to stack 3.

The force P with which the upper roller 10 is pressed downward is controlled over a line 32. In a preferred embodiment, the lower roller 14 is held stationary. However, the load can also move in the opposite direction, so that force P acts on lower roller 14 and the upper roller 10 is held stationary. The load determines the compressive stress that is applied in the individual working nips 19–22. This compressive stress increases from the top to the bottom because the effective weight of the individual rollers is added to the loading force P. However, the increase in force in each stack according to the present invention is less than in supercalenders of the prior art that have from 9 to 16 rollers.

Devices 35 and 36 for deflection compensation of the upper roller 10 and the lower roller 14, respectively, are pressurized with pressure devices over lines 33 and 34. These devices ensure that there is an even compressive stress applied over the axial length of the rollers. Any conventional deflection compensating devices can be used. However, it is preferred to use those devices in which support elements are arranged next to each other in a row, which elements can be pressurized individually or in zones at different pressures.

Hard rollers 10, 12, and 14 are heatable as shown by arrows H. The heat energy that is added is controlled by control units 29, 30 along dot-and-dash paths 37–39. The heating may be effected, for example, by electric heating or radiant heating or a heat exchange medium. A protective hood 40 provides heat insulation and ensures that the heat that is radiated as a result of the heating is exhausted into the surrounding environment to only a minimal extent.

The average compressive stress $\sigma$ applied in the lowest working nip 22, and preferably in all of the working nips 15–22, is preferably maintained between 45 and 60 N/mm$^2$ due to force P. The surface temperature of the heatable rollers 5, 7, 9, 10, 12, and 14 is preferably maintained between 100° C. and 150° C. due to heating H. The diameter of the rollers and the elasticity of the covering 28 are selected so that a nip width of about 2–15 mm, and preferably about 8 mm, is maintained. The dwell times t of the web 23 in each working nip is about 0.1 to 0.9 ms. The dwell time is a function of the web speed. In a preferred embodiment, the temperature T is only slightly above the lower limit, for example 110° C., and the compressive stress is only slightly above the lower limit, for example, 50 N/mm$^2$. The printability of natural and lightly coated papers is not necessarily related to the gloss or smoothness achieved in the paper web, but is instead related to compression or its reciprocal bulk value (in $cm^3/g$). The measurement of printability in photogravure printing is determined by the number of "missing dots" in the quartertone and halftone area. The best results in this regard are thus obtained when it is ensured that all of the parameters specified above are maintained in all of the working nips.

The results of paper treatment can often be improved when the rollers, particularly the middle rollers, are held by levers (not shown), so that the overhanging weights are preferably compensated for by support devices, as is known from European reference EP 0 285 942 B1.

Preferably, in each stack 3, 4, the upper rollers 5, 10, the lower rollers 9, 14, and the middle rollers 7, 12 are constructed as hard rollers that cooperate with soft rollers 6, 8, 11, and 13. However, it is possible to make the first three rollers mentioned above soft rollers and to have the middle rollers 6, 8, 11, and 13 be hard, preferably, heatable rollers.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A calender for treating both sides of a paper web, comprising:

two roller stacks, each of which is loaded on one end by a load, each roller stack comprising:

at least two hard rollers having a substantially smooth outer surface, said at least two hard rollers each including means for heating a surface of said at least two hard rollers to a temperature of at least 100° C.; and at least two soft rollers, wherein each of said at least two soft rollers is disposed adjacent to at least one of said at least two hard rollers to form a working nip therebetween, wherein at least one working nip has a predetermined width so that a dwell time of said paper web passing through said at least one working nip is at least 0.1 ms, said roller stack being loaded to produce an average compressive stress in said at least one working nip of at least 42 $N/mm^2$.

2. The calender of claim 1, wherein each roller stack comprises three hard rollers and two soft rollers with a changeover being formed between said two roller stacks.

3. The calender of claim 1, wherein for at least one working nip, the dwell time is a maximum of 0.9 ms, the heating produces a maximum surface temperature of 150° C., and the load produces a maximum average compressive stress of 60 $N/mm^2$.

4. The calender of claim 1, wherein the dwell time ranges from 0.2 ms to 0.5 ms, the surface temperature ranges from 110° C. to 125° C., and the average compressive stress ranges from 45 $N/mm^2$ to 55 $N/mm^2$.

5. The calender of claim 1, wherein at least one of the upper and lower rollers are deflection-controllable.

6. The calender of claim 1, wherein at least one of the upper and lower rollers are hard rollers and include said heating means.

7. The calender of claims 1, wherein said at least two soft rollers include a plastic covering.

8. The calender of claim 7, wherein said plastic covering supports a compressive stress of up to 60 $N/mm^2$.

9. The calender of claim 7, wherein said plastic covering is substantially comprised of a fiber-reinforced epoxy resin.

10. The calender of claim 1, wherein the roller stack is arranged in-line with one of a paper machine and a coating machine.

11. The calender of claim 1, wherein each of said at least two hard rollers and said at least two soft rollers are driven independently.

12. The calender of claim 1, wherein said roller stack is covered by a protective hood that reduces heat radiation emitting from said roller stack.

13. The calender of claim 1, wherein each roller stack comprises five rollers.

14. The calender of claim 13, wherein each roller stack comprises three soft rollers and two hard rollers.

15. The calender of claim 14, wherein a changeover is formed between said two roller stacks.

* * * * *